US012704037B2

(12) United States Patent
Doran et al.

(10) Patent No.: US 12,704,037 B2
(45) Date of Patent: Aug. 11, 2026

(54) HIGH TORQUE ACTUATED TUBING HANGER ORIENTATION

(71) Applicant: FMC Kongsberg Subsea AS, Kongsberg (NO)

(72) Inventors: Thomas Doran, Kongsberg (NO); Graham Ford, Holmestrand (NO); Alexey Voronezhev, Oslo (NO); Marcel Rozek, Cracow (PL); Frank Wergeland, Erdal (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 18/906,512

(22) Filed: Oct. 4, 2024

(65) Prior Publication Data

US 2026/0098452 A1 Apr. 9, 2026

(51) Int. Cl.
*E21B 33/038* (2006.01)
*E21B 33/064* (2006.01)

(52) U.S. Cl.
CPC ..... *E21B 33/038* (2013.01); *E21B 33/064* (2013.01)

(58) Field of Classification Search
CPC ..... E21B 33/038; E21B 33/064
USPC ..... 166/338
See application file for complete search history.

(56) References Cited

U.S. PATENT DOCUMENTS 5,429,188 A 7/1995 Cameron et al.
6,724,924 B1 * 4/2004 Wei ..... G06T 7/74 382/190
6,725,924 B2 * 4/2004 Davidson ..... E21B 33/0355 166/336
6,834,717 B2 12/2004 Bland
7,114,571 B2 * 10/2006 Gatherar ..... E21B 33/043 166/89.2
8,763,708 B2 7/2014 Travis et al.
9,222,321 B2 12/2015 Nellessen, Jr. et al.
10,138,699 B2 11/2018 Nguyen
10,422,196 B2 * 9/2019 Levert, Jr ..... F16K 11/076
10,837,251 B2 * 11/2020 Foley ..... E21B 33/035
11,015,412 B2 * 5/2021 Robottom ..... E21B 33/047
11,180,968 B2 11/2021 Mitchell et al.
(Continued)

FOREIGN PATENT DOCUMENTS

EP 3399139 A1 11/2018
GB 2600771 A 5/2022

OTHER PUBLICATIONS

PCT Patent Application PCT/EP2025/078285 International Search Report and Written Opinion of the International Searching Authority issued Dec. 8, 2025.
(Continued)

*Primary Examiner* — Matthew R Buck
*Assistant Examiner* — Douglas S Wood
(74) *Attorney, Agent, or Firm* — Erise IP, P.A.

(57) ABSTRACT

Systems, methods, and devices for blowout preventer independent alignment and installation of a tubing hanger within a subsea well system. A tubing hanger orientation assembly may be included with a rotary actuator that provides high torque adjustment and fine alignment of the tubing hanger with respect to other subsea equipment. At least one sensor may be included to measure and confirm an orientation of the tubing hanger for proper alignment and connection to a subsea wellhead.

20 Claims, 10 Drawing Sheets

(56) References Cited

U.S. PATENT DOCUMENTS

| | | | | |
|---|---|---|---|---|
| 2002/0000315 | A1* | 1/2002 | Kent | E21B 33/04 166/85.4 |
| 2004/0104024 | A1* | 6/2004 | Kent | F16K 3/02 166/368 |
| 2004/0140124 | A1* | 7/2004 | Fenton | E21B 43/36 166/357 |
| 2011/0232474 | A1* | 9/2011 | Geiger | E21B 33/06 91/159 |
| 2014/0054044 | A1 | 2/2014 | Nellessen, Jr. et al. | |
| 2015/0259990 | A1* | 9/2015 | June | E21B 33/038 166/341 |
| 2018/0179839 | A1* | 6/2018 | Nguyen | E21B 33/0415 |
| 2024/0068360 | A1 | 2/2024 | Farquharson et al. | |
| 2024/0209710 | A1 | 6/2024 | Deberry et al. | |
| 2024/0426187 | A1 | 12/2024 | Spitz et al. | |

OTHER PUBLICATIONS

PCT Patent Application PCT/EP2025/077882 International Search Report and Written Opinion of the International Searching Authority issued Nov. 26, 2025.

U.S. Appl. No. 18/906,791, Notice of Allowance issued Aug. 12, 2025.

* cited by examiner

HIGH TORQUE ACTUATED TUBING HANGER ORIENTATION

BACKGROUND

1. Field

Embodiments of the present disclosure relate to subsea well systems. More specifically, embodiments of the present disclosure relate to tubing hanger orientation equipment for subsea well systems.

2. Related Art

In subsea well systems, such as, a vertical in the well (V-ITW) system, tubing hanger assemblies are typically installed using a tubing hanger orientation joint together with a BOP pin to orient them correctly relative to the template structure or permanent guide base (PGB). Rotation is achieved by lifting a string using a top drive component causing the BOP pin to interact against a helical interface on the string. Typical installation techniques calibrate the tubing hanger orientation joint prior to running the tubing hanger assembly subsea and then rely on the tubing hanger orientation joint and BOP pin to correctly orient the tubing hanger. However, there is no way of confirming proper alignment until after BOP removal. Accordingly, if the tubing hanger is not properly aligned, rerunning completion or modification of the tree may be needed.

Further, current techniques of measuring the orientation of the tubing hanger assembly and associated components rely on interface data and a complicated tolerance loop with limited repeatability. Current techniques are also not capable of measuring tubing hanger orientation independently of a blowout preventer assembly.

SUMMARY

Embodiments of the present disclosure may solve the above-mentioned problems by providing accurate and repeatable subsea rotational adjustment equipment operable to provide high torque and fine alignment or adjustment after initial landing of a tubing hanger and tubing hanger orientation assembly. Further, embodiments of the present disclosure provide accurate measurement of the tubing hanger rotational orientation independent of other subsea equipment.

In some aspects, the techniques described herein relate to a tubing hanger orientation assembly for coupling a tubing hanger assembly to a wellhead, the tubing hanger orientation assembly including: a tubing hanger orientation mandrel operable to be placed within an internal bore of a blowout preventer (BOP) associated with the wellhead; a rotary actuator operable to drive rotation of the tubing hanger orientation mandrel with respect to the BOP; a reaction point for rotation of the tubing hanger orientation mandrel with respect to the BOP; and at least one gyroscopic sensor operable to measure an orientation of the tubing hanger assembly.

In some aspects, the techniques described herein relate to a tubing hanger orientation assembly for coupling a tubing hanger assembly to a wellhead, the tubing hanger orientation assembly including: a tubing hanger orientation mandrel operable to be placed within an internal bore of a blowout preventer (BOP) associated with the wellhead; a rotary actuator operable to drive rotation of the tubing hanger orientation mandrel with respect to the BOP; a brake operable to interface with an internal surface of the internal bore of the BOP such that a reaction point is provided for rotation of the tubing hanger orientation mandrel with respect to the BOP; and at least one gyroscopic sensor operable to measure an orientation of the tubing hanger assembly.

In some aspects, the techniques described herein relate to a tubing hanger orientation assembly for coupling a tubing hanger assembly to a wellhead, the tubing hanger orientation assembly including: a tubing hanger orientation mandrel operable to be placed within an internal bore of a blowout preventer (BOP) associated with the wellhead; a rotary actuator operable to drive rotation of the tubing hanger orientation mandrel with respect to the BOP; a BOP pin receiving structure that interfaces with a BOP pin of the BOP, thereby providing a reaction point for rotation of the tubing hanger orientation mandrel with respect to the BOP; and at least one gyroscopic sensor operable to measure an orientation of the tubing hanger assembly.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

BRIEF DESCRIPTION OF THE DRAWING FIGURES

Embodiments of the present disclosure are described in detail below with reference to the attached drawing figures, where:

Figure 1:
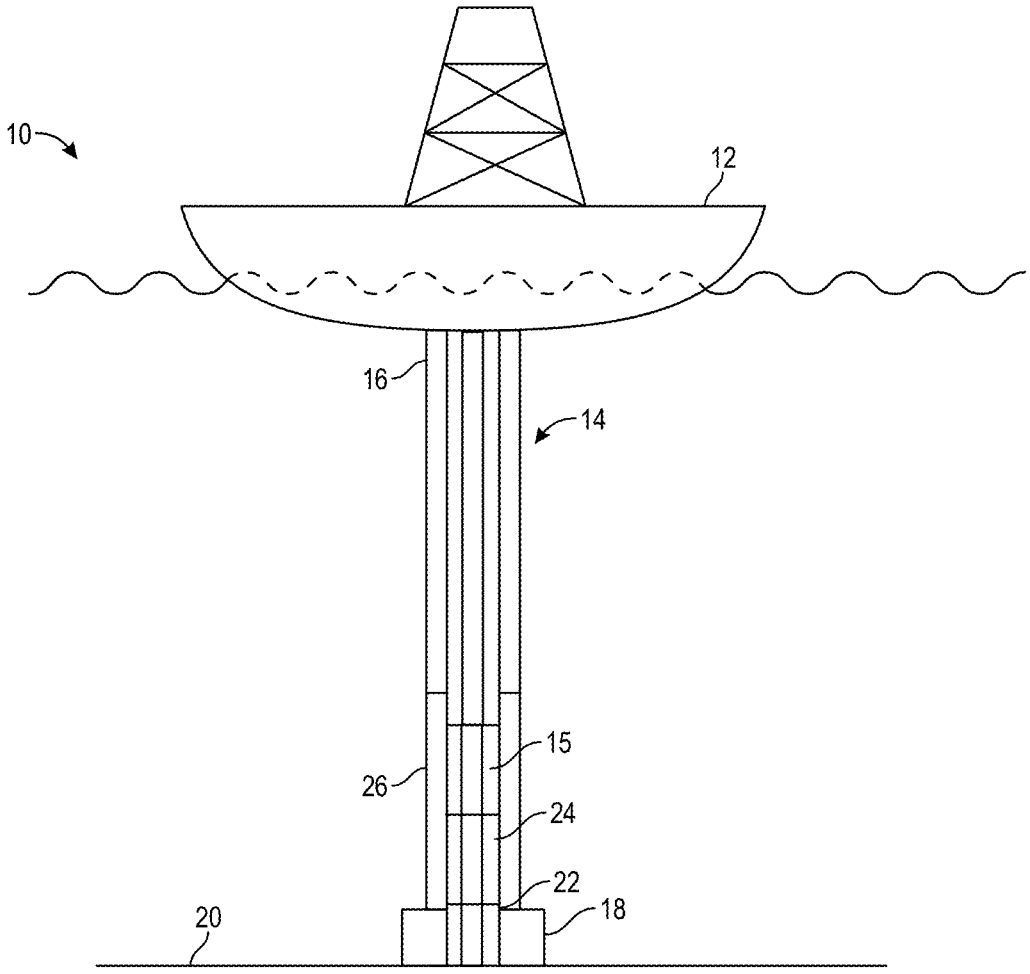
FIG. 1 illustrates an exemplary subsea well system relating to some embodiments of the present disclosure.

The drawing figures do not limit the present disclosure to the specific embodiments disclosed and described herein.

The drawings are not necessarily to scale, emphasis instead being placed upon clearly illustrating the principles of the present disclosure.

DETAILED DESCRIPTION

The following detailed description references the accompanying drawings that illustrate specific embodiments in which the present disclosure can be practiced. The embodiments are intended to describe aspects of the present disclosure in sufficient detail to enable those skilled in the art to practice the present disclosure. Other embodiments can be utilized, and changes can be made without departing from the scope of the present disclosure. Therefore, the following detailed description is not to be taken in a limiting sense. The scope of the present disclosure is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc., described in one embodiment may also be included in other embodiments but is not necessarily included. Thus, the technology can include a variety of combinations and/or integrations of the embodiments described herein.

Embodiments of the present disclosure relate to tubing hanger orientation equipment to install a tubing hanger assembly within a subsea well system and attach the tubing hanger assembly to a wellhead. A high torque motor or other high-torque rotary actuator may be used to provide post-landing adjustment and fine alignment of the tubing hanger responsive to an orientation verification from at least one sensor, such as a gyroscopic sensor. In some embodiments, additional gyroscopic sensors such as one or more external gyroscopes may be used as a reference for the at least one sensor. Prior art methods of tubing hanger orientation typically rely on a helix and blowout preventer (BOP) pin interface orient the tubing hanger and thus, are unable to provide fine alignment adjustment and adjusting after initial landing of the tubing hanger. Further, prior art methods may utilize topside equipment such as a top drive to provide rough orientation but do not provide any means for fine alignment.

FIG. 1 illustrates an exemplary subsea well system 10 relating to some embodiments of the present disclosure. In some embodiments, a surface platform 12, such as a mobile vessel or permanent structure, is included disposed at surface level above the subsea well system 10. A string assembly 14 may be coupled to the surface platform 12. For example, the string assembly 14 may include a tubing string or landing string 15 configured to be placed within a riser structure 16 and lowered to a wellhead 18 at seabed 20, as shown.

In some embodiments, a tubing hanger 22 is lowered to the wellhead 18 for coupling to the wellhead 18. For example, the tubing hanger 22 is lowered down to the wellhead 18 through a bore of the string assembly 14 and positioned using a tubing hanger running tool 24. In some embodiments, the subsea well system 10 further comprises a blowout preventer (BOP) 26, a BOP stack, or a BOP assembly for preventing leaking and for monitoring and controlling aspects of the subsea well system 10. In some embodiments, the landing string 15 is included above the tubing hanger running tool 24, as shown.

In some embodiments, the BOP 26 is coupled to the wellhead 18, for example, using any combination of fasteners or other connecting components. The BOP 26 may include a BOP stack with a plurality of blowout prevent components. In some embodiments, the tubing hanger 22 and the tubing hanger running tool 24 are lowered to the wellhead 18 through an internal bore of the BOP 26, as shown. As will be described in further detail below, interfacing with the BOP 26 may be used to provide a reaction point for rotating and aligning the tubing hanger running assembly to position the tubing hanger 22 with respect to the wellhead 18 and other components.

In some embodiments, the tubing hanger 22 is configured to be coupled to a subsea tree after installation of the tubing hanger 22. As such, the tubing hanger 22 orientation with respect to other components of the subsea well system 10 may be predetermined to interface with a predetermined orientation for the subsea tree. For example, a predetermined orientation and positioning of the subsea tree may ensure that a production outlet of the subsea tree properly interfaces with other components such as a subsea manifold and connections therebetween. Further, the subsea tree orientation may be determined to interface with other components disposed on the seabed.

In some embodiments, a number of additional components not explicitly shown may be included within the subsea well system 10. For example, any combination of additional subsea trees, manifolds, tubing structures, risers, and other subsea components may be included.

Figure 2:
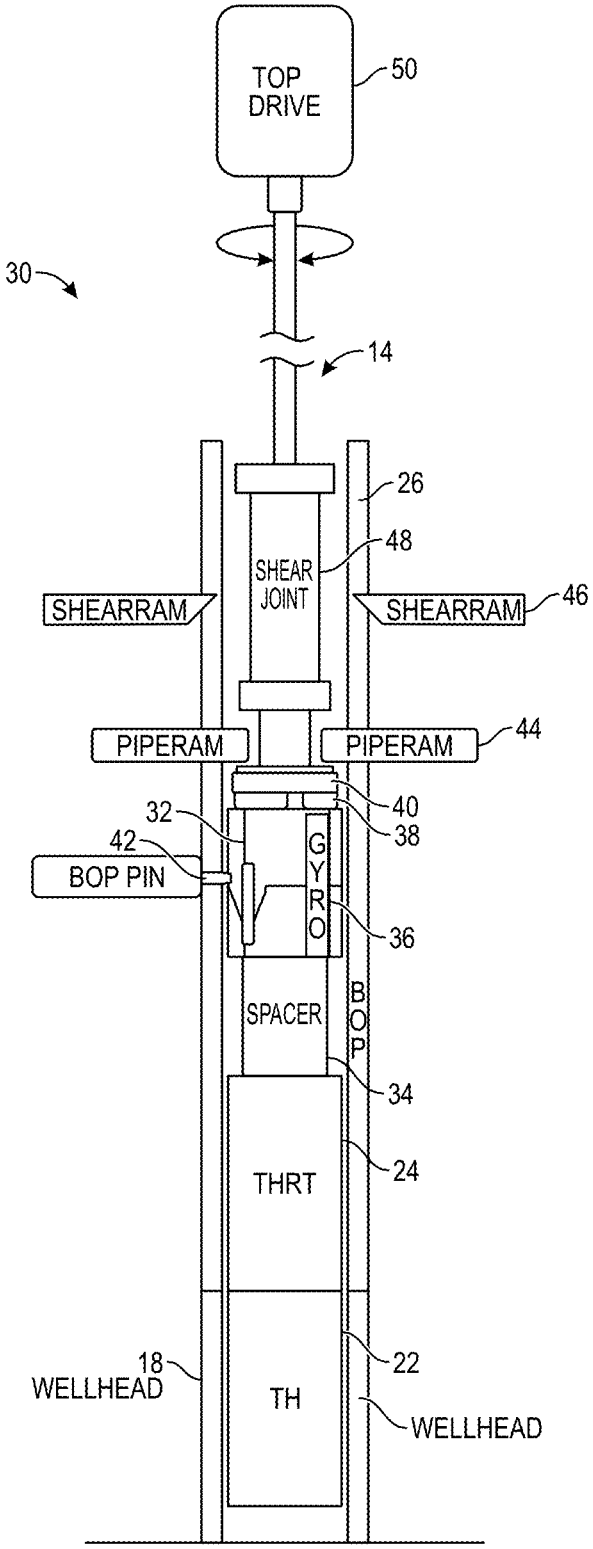
FIG. 2 illustrates an exemplary tubing hanger orientation system relating to some embodiments of the present disclosure.

FIG. 2 illustrates an exemplary tubing hanger orientation system 30 relating to some embodiments of the present disclosure. In some embodiments, the tubing hanger orientation system 30 interfaces with components of the subsea well system 10 described above. For example, the tubing hanger orientation system 30 may interface with portions of the wellhead 18 and BOP 26, as shown. The tubing hanger orientation system 30 may be used to lower the tubing hanger 22 and position within the BOP 26 for installation and coupling with the wellhead 18. For example, the tubing hanger running tool 24 and tubing hanger 22 are lowered with the string assembly 14 and run through an internal bore of the BOP 26 for coupling with the wellhead 18.

In some embodiments, the tubing hanger orientation system 30 comprises a tubing hanger orientation joint structure 32. The tubing hanger orientation joint structure 32 may include a substantially cylindrical and longitudinal shape. For example, in some embodiments, the tubing hanger orientation joint 32 includes an inner mandrel portion that is part of or coupled to the string assembly 14 and a cylindrical outer sleeve disposed around the inner mandrel portion, which may be independently rotatable from the inner mandrel portion. However, embodiments are contemplated with alternate shapes and structural portions. In some embodiments, at least one spacer 34 is disposed between the tubing hanger orientation joint structure 32 and the tubing hanger running tool 24. For example, the spacer 34 may vertically offset at least a portion of the tubing hanger orientation joint structure 32. In some embodiments, a plurality of spacers may be included.

In some embodiments, the tubing hanger orientation system 30 further includes at least one sensor 36, such as a gyroscopic sensor (or simply "gyroscope"), configured to measure an orientation of the tubing hanger orientation system 30. For example, the gyroscope 36 may be disposed on the tubing hanger orientation joint structure 32, as shown. However, embodiments are contemplated in which the gyroscope 36 is disposed elsewhere on the tubing hanger orientation system 30. Further, in some embodiments, the gyroscope 36 is coupled to either of the tubing hanger running tool 24 or the tubing hanger 22. The gyroscope 36 may be used to verify and/or determine a rotational orientation of the tubing hanger 22. In some embodiments, the at least one sensor 36 comprises another suitable form of orientation sensor. For example, embodiments are contemplated in which any of gyroscopes, rotary encoders, accelerometers, or magnetic sensors, as well as combinations thereof are used to determine and verify orientation of the tubing hanger orientation system 30.

The tubing hanger orientation system 30 further includes a rotary actuator 38 operable to drive rotation of the tubing hanger 22 and attached structures. For example, in some embodiments, the tubing hanger 22, the tubing hanger running tool 24, and at least a portion of the tubing hanger orientation joint structure 32 are structurally coupled such that the components rotate as a monolithic structure. However, it should be understood that portions of the tubing hanger orientation joint structure 32 may rotate independently from the tubing hanger 22. In some embodiments, a control unit 40 is included. For example, the control unit 40 may be coupled to the rotary actuator 38 to control rotation of the tubing hanger orientation system 30. In some embodiments, an automated feedback loop may be provided between the gyroscope 36, the rotary actuator 38, and the control unit 40. For example, the control unit 40 may control the rotary actuator 38 based at least in part on a signal from the gyroscope 36. As such, embodiments are contemplated in which the rotary actuator 38 may be automatically driven based on a signal from the gyroscope 36.

In some embodiments, the BOP 26 includes a BOP pin 42. The BOP pin 42 may interface with a portion of the tubing hanger orientation joint structure 32, as shown. For example, in some embodiments, the tubing hanger orientation joint structure 32 comprises a helix structure and slot structure configured to receive and react against the BOP pin 42, as will be described in further detail below. Accordingly, in some embodiments, the BOP pin 42 is interfaced with a BOP pin receiving structure on the tubing hanger orientation joint structure 32 to provide a reaction point for rotating the tubing hanger orientation system 30 for connection to the wellhead 18.

In some embodiments, the BOP 26 further includes one or more ram devices such as at least one pipe ram 44 and at least one shear ram 46, as shown. The pipe ram 44 may be operable to close an annular space between the wellbore and pipe. The shear ram 46 may be used to shear the pipe and isolate at least a portion of the well system 10. In some embodiments, the BOP 26 may include any combination of additional components not explicitly shown, such as, for example, blind rams, electrical lines, hydraulic lines, control units, and valves.

In some embodiments, the string assembly 14 includes a shear joint 48 operable to interface with the shear ram 46. For example, the shear ram 46 may interface with the shear joint 48 to isolate the well and establish barriers between hydrocarbons and the subsea environment. In some embodiments, a top drive 50 is included that drives rotation of the landing string from surface level. However, the top drive 50 may be incapable of providing fine adjustment or alignment of the tubing hanger orientation system 30.

In some embodiments, the rotary actuator 38 includes a high torque actuator capable of high torque rotation of the tubing hanger orientation joint structure 32. By contrast, the top drive 50 may only be capable of providing rough alignment through the string assembly 14. As such, the rotary actuator 38, as well as other rotary actuators described herein provide a relatively higher accuracy alignment. For example, low torque rotation techniques may be limited to a few hundred ft-lbs of torque and typically rely on orienting a guide structure or end stop, then using a top drive to lift the string assembly and react against a BOP structure, such as the BOP pin to provide rotation. In some embodiments, high torque rotation refers to a torque that allows active orientation of the tubing hanger heading including upper completion and adjustment. In some embodiments, high torque refers to a torque of above 10,000 ft-lbs. Alternatively, or in addition, embodiments are contemplated in which a high torque value is above 1,000 ft-lbs, 5,000 ft-lbs, 8,000 ft-lbs, or above 15,000 ft-lbs.

In some embodiments, at least one electrical subsea communication module (ESCM) or electrical subsea control module is included, for example, disposed below and/or above the pipe rams 50. For example, in some embodiments, an ESCM is disposed above and below the pipe rams 50. In some embodiments, the ESCM is included on, integrated into, or coupled to the control unit 40. In some embodiments, the ESCM is operable to provide communication and control between subsea and topside components.

Figure 3:
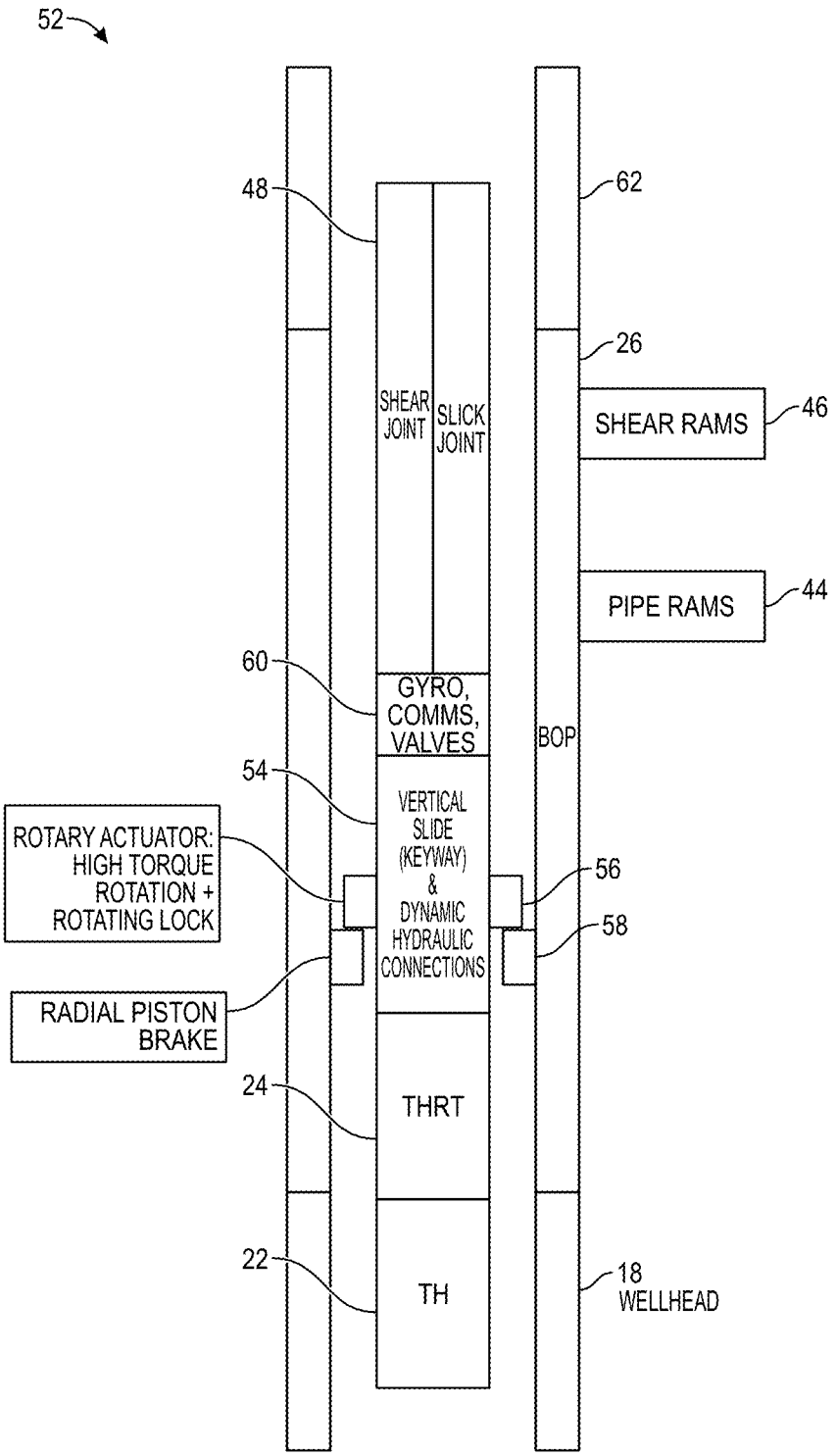
FIG. 3 illustrates another exemplary tubing hanger orientation system relating to some embodiments of the present disclosure.

FIG. 3 illustrates another exemplary tubing hanger orientation system 52 relating to some embodiments of the present disclosure. The exemplary tubing hanger orientation system 52 may include many similar components described above with respect to the tubing hanger orientation system 30 of FIG. 2; however, the exemplary tubing hanger orientation system 52 may not include or utilize the BOP pin 42 in a similar way. For example, the tubing hanger orientation system 52 does not use the BOP pin 42 as a reaction point for rotation. Instead, the tubing hanger orientation system 52 uses a braking mechanism to provide a reaction point for rotating and aligning the tubing hanger orientation system 52. Additionally, embodiments are contemplated in which other means of providing a reaction point are used. For example, in some embodiments, any combination of brakes, BOP pin and other interfaces, pipe rams, and annular preventers are used as a reaction point. In some embodiments, the pipe rams 44 may be extended to contact a surface of the tubing hanger orientation system 52 to provide a reaction point. As such, the pipe rams 44 may be used to hold a fixed portion of the tubing hanger orientation system 52 in place while the rotary actuator 56 is used to rotate the tubing hanger running tool 24 and tubing hanger 22.

The tubing hanger orientation system 52 includes a vertical slide structure 54 coupled to the tubing hanger running tool 24, as shown. The vertical slide structure 54 may include a keyway structure as well as dynamic hydraulic connections to other components of the tubing hanger orientation system 52. The keyway structure may be used to keep alignment during vertical stroking of the assembly. For example, the alignment of the tubing hanger 22 may be held by a key or pin structure disposed through the keyway such that the assembly can be moved up and down while maintaining correct heading.

The tubing hanger orientation system 52 further includes a rotary actuator 56. The rotary actuator 56 may be similar to the rotary actuator 38, as described above. However, the rotary actuator 56 may be coupled to a brake 58, which may include a radial piston brake with a plurality of radial pistons configured to brake against a portion of the BOP 26, such as an internal bore of the BOP 26. Accordingly, the brake 58 may provide a reaction point for rotation of the rotary actuator 56 to rotate the tubing hanger orientation system 52 and secure the tubing hanger 22 to the wellhead 18. In some embodiments, the brake 58 includes a weak link or load limiter operable to free the brake system in the event of heave compensation lockup and/or brake lock. For example, embodiments are contemplated in which the brake 58 includes a load-dependent force regulator or a proportional load limiting valve operable to prevent brake lockup.

The tubing hanger orientation system 52 further includes a control portion 60, as shown. The control portion 60 includes at least one sensor, such as the gyroscope 36, for determining the orientation of the tubing hanger assembly, as described above. In some embodiments, control portion 60 further includes one or more communication devices operable to receive and transmit signals with a surface control portion or between components of the subsea assembly. Additionally, in some embodiments, the control portion 60 includes one or more valves such as hydraulic valves coupled to the rotary actuator 56. In some embodiments, each of one or more gyroscopic sensors, one or more communication devices, and one or more valves are included in the control portion 60. Additionally, or in the alternative, embodiments are contemplated in which at least one of the components described above are disposed elsewhere, for example, in separate control portions or as standalone devices. Further, in some embodiments, one or more control portions may be disposed elsewhere within the tubing hanger orientation system 52 or on other components of the subsea system 10.

In some embodiments, the BOP 26 includes similar components as described above with respect to FIG. 2. For example, the BOP 26 includes at least one pipe ram 44 and shear ram 46. However, embodiments are contemplated in which the BOP pin 42 is not used to provide a reaction point, as described above, and instead, the brake 58 is used to react against the BOP 26. Further, the string assembly 14 may include a slick joint 62, as shown. The slick joint 62 may be configured to prevent damage to other riser components. In some embodiments, the shear joint 48, as described above, is included within the string assembly 14 of tubing hanger orientation system 52. Further, embodiments are contemplated in which other means are used to provide a reaction point for rotation. For example, in some embodiments, the pipe rams 44 are used to engage an outer surface of the tubing hanger orientation system 52. In some such embodiments, engagement between the pipe rams 44 and the outer surface of the tubing hanger orientation system 52 to fix an outer sleeve portion of the tubing hanger orientation system 52 such that an unfixed portion can rotate with respect to the sleeve portion.

Figure 4:
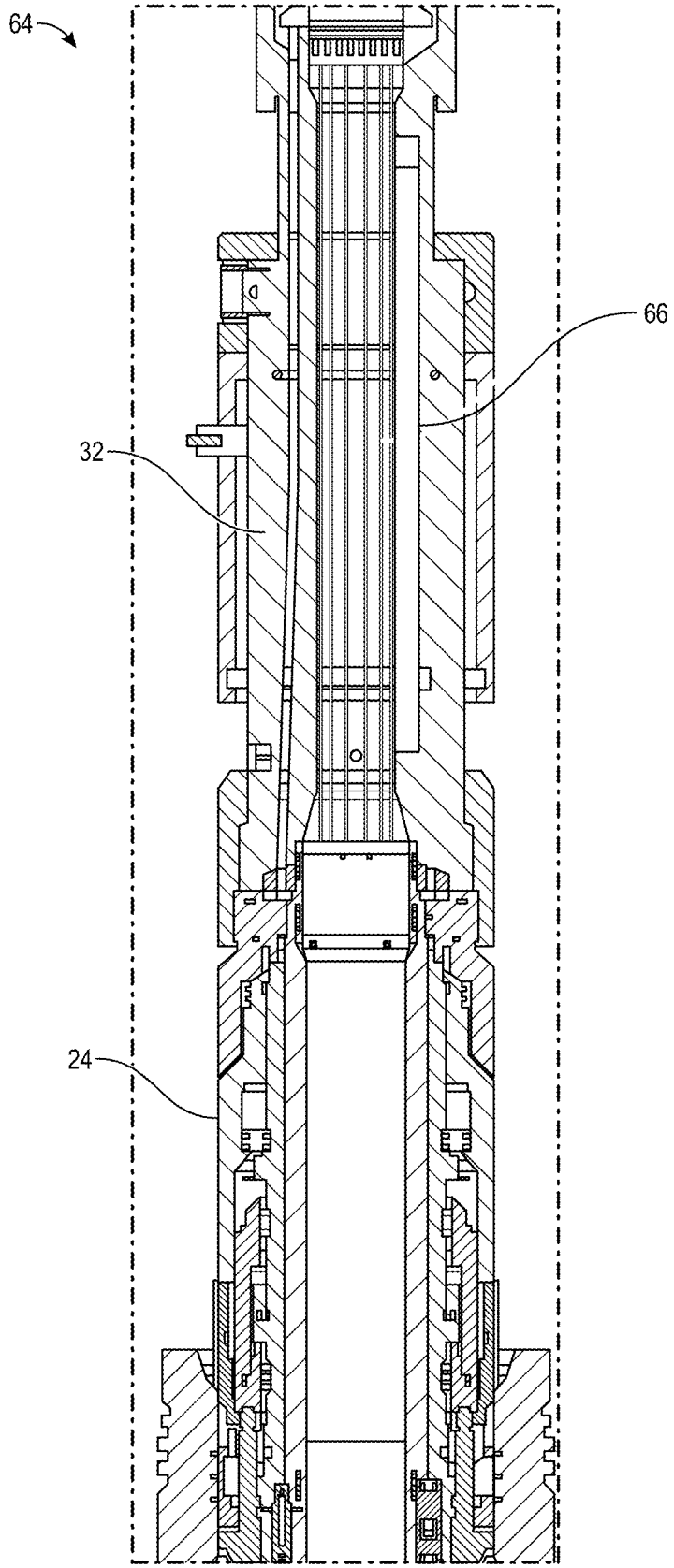
FIG. 4 illustrates a cross-sectional view of an exemplary gyroscope mounting location within an exemplary tubing hanger orientation assembly relating to some embodiments of the present disclosure.

FIG. 4 illustrates a cross-sectional view of an exemplary gyroscope (or other sensor) mounting location within an exemplary tubing hanger orientation assembly 64 relating to some embodiments of the present disclosure. The exemplary tubing hanger orientation assembly 64 includes the tubing hanger running tool 24 and tubing hanger orientation joint structure 32. Further, a linear gyroscope 66 may be disposed on a portion of tubing hanger orientation joint structure 32, as shown. In some embodiments, the gyroscope 36, as described above, includes the linear gyroscope 66, which may include any suitable form of gyroscopic sensor, such as, a mechanical gyroscope or an optical gyroscope. The linear gyroscope 66 may be used to determine or verify a rotational orientation of the exemplary tubing hanger orientation assembly 64. It should be understood that a similar gyroscope component is contemplated for tubing hanger orientation system 52. For example, linear gyroscope 66 may be disposed within the control portion 60 of tubing hanger orientation system 52. The linear gyroscope 66 may be disposed outside of a bore of the tubing hanger orientation joint structure 32, as shown. However, it should be understood that other suitable mounting locations are also contemplated. For example, in some embodiments, the linear gyroscope 66 may be disposed inside of a bore of the tubing hanger orientation joint structure 32 or tubing hanger running tool 24.

In some embodiments, other mounting locations are contemplated for linear gyroscope 66 or other gyroscopic components described herein. For example, at least one gyroscope may be disposed at a coupling of the tubing hanger orientation joint structure 32 with a component of the string assembly 14 or directly onto one of the tubing hanger 22 or the tubing hanger running tool 24. Further, in some embodiments, a plurality of gyroscopes is included. For example, two or more gyroscopes may be used to provide verification in the orientation determination and to provide redundancy. Further still, in some embodiments, one or more external gyroscopes may be included to provide a reference for the tubing hanger orientation system 30 or the tubing hanger orientation system 52.

Figure 5:
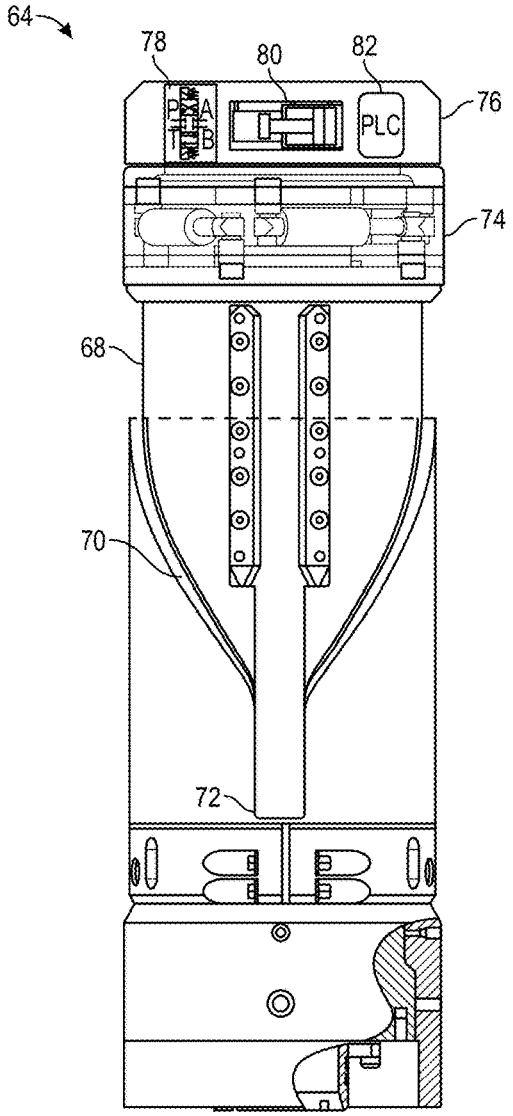
FIG. 5 illustrates a portion of exemplary tubing hanger orientation assembly relating to some embodiments of the present disclosure.

FIG. 5 illustrates a portion of exemplary tubing hanger orientation assembly 64 relating to some embodiments of the present disclosure. The exemplary tubing hanger orientation assembly 64 includes a tubing hanger orientation mandrel 68. The tubing hanger orientation mandrel 68 may have a longitudinal structure with a helix structure 70 disposed on an outer surface of the tubing hanger orientation mandrel 68, as shown. For example, the helix structure 70 may be configured to receive the BOP pin 42 and guide the BOP pin into a slot 72 disposed on the tubing hanger orientation mandrel 68.

The exemplary tubing hanger orientation assembly 64 further comprises a high torque motor 74. For example, in some embodiments, either of the rotary actuators 38 or 56 may include high torque motor 74. In some embodiments, the high torque motor 74 includes a plurality of linear actuators such as hydraulic pistons configured to rotate the tubing hanger 22. For example, the BOP pin 42 may lock into the slot or another keyhole on the tubing hanger orientation mandrel 68 to provide a reaction point to rotate the exemplary tubing hanger orientation assembly 64 using the high torque motor 74.

In some embodiments, the exemplary tubing hanger orientation assembly 64 further includes a control unit 76. The control unit 76 may include any combination of a control circuit 78, a hydraulic piston 80, and a programmable logic controller (PLC) 82. In some embodiments, the control circuit 78 comprises a directional proportional hydraulic circuit operable to communicate actuation of the high torque motor 74. Further, the PLC 82 may be programmed to control the control circuit 78 and control actuation of the hydraulic piston 80. For example, a plurality of hydraulic pistons of the high torque motor 74 may be actuated in unison to torque the exemplary tubing hanger orientation assembly 64.

In some embodiments, other suitable means of controlling the equipment of the exemplary tubing hanger orientation assembly 64 are contemplated. For example, a plurality of separate control components or a control component disposed within a separate location within the exemplary tubing hanger orientation assembly 64 may be included. Further, in some embodiments, a control system, such as the control unit 76 may be used to provide autonomous or semi-autonomous control of the subsea equipment.

Figure 6:
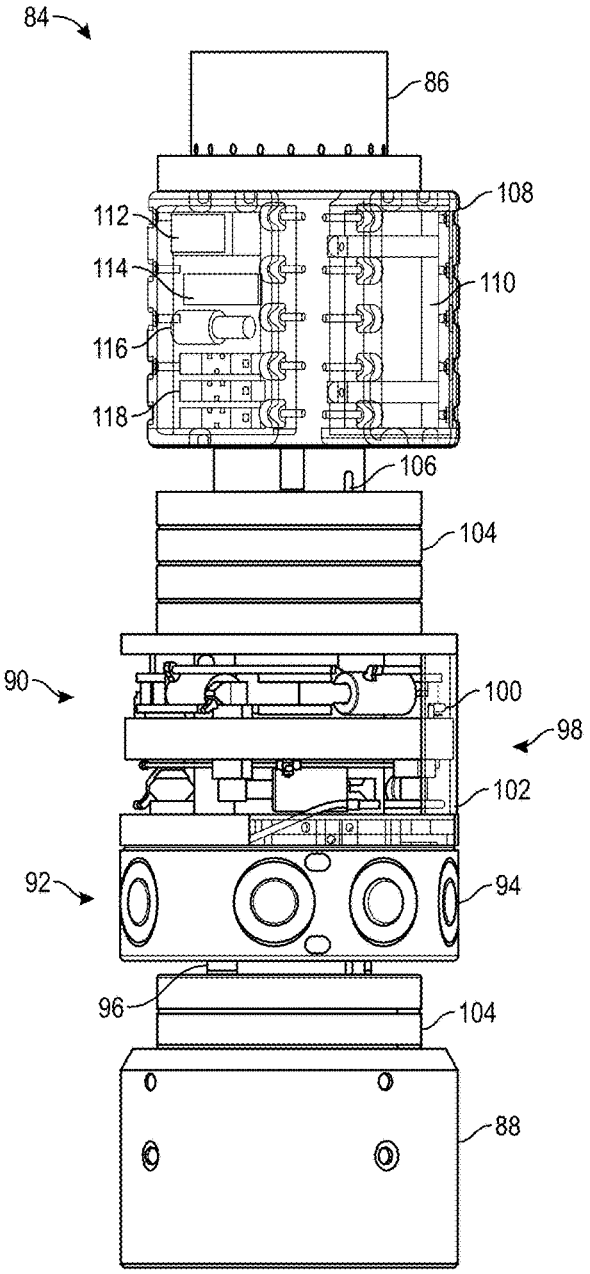
FIG. 6 illustrates an exemplary tubing hanger orientation assembly relating to some embodiments of the present disclosure.

FIG. 6 illustrates an exemplary tubing hanger orientation assembly 84 relating to some embodiments of the present disclosure. The tubing hanger orientation assembly 84 comprises a tubing hanger running tool body 86 and an adapting structure 88, as shown. The adapting structure 88 may include a nut for adapting the tubing hanger running tool body 86 to one or more other components. The tubing hanger running tool body 86 may be secured to the landing string and therefore does not move relative to the string and tubing hanger 22.

The tubing hanger orientation assembly 84 further includes a shuttle assembly 90. The shuttle assembly 90 includes a brake assembly 92 having one or more radial pistons 94 and a vertically oriented standoff piston 96. The standoff piston 96 may be operable to provide and maintain a vertical clearance to allow upward stroking of the tubing hanger orientation assembly 84. The shuttle assembly 90 further includes an actuator assembly 98 operable to drive rotation of the tubing hanger orientation assembly 84 relative to a fixed point of the brake assembly 92. In some embodiments, the actuator assembly 98 has a multi-stage layout including a first stage actuator array 100 and a second stage actuator array 102. Accordingly, each actuator assembly stage is able to rotate relative to the other stages. In some embodiments, a lower portion of the second stage actuator array 102 may be fixed to the brake assembly 92 and an upper portion of the first stage actuator array 100 is fixed to the tubing hanger running tool body 86 of the tubing hanger orientation assembly 84.

In some embodiments, the components of the shuttle assembly 90 are provided with a clam-shell layout. For example, the brake assembly 92 and the actuator assembly 98 may include two or more distinct sections that are configured to be disposed on opposing sides of the longitudinal structure of the tubing hanger orientation assembly 84. Accordingly, the shuttle assembly 90 may be placed around the longitudinal structure without removing end portions of the longitudinal structure. Instead, for example, two separate side structures may be placed on opposing sides of the longitudinal structure and fastened together.

In some embodiments, the tubing hanger orientation assembly 84 includes a plurality of spacers 104. For example, one or more spacers 104 may be disposed above the shuttle assembly 90 and one or more spacers 104 may be disposed below the shuttle assembly 90. The plurality of spacers 104 may be disposed around an outer diameter of a longitudinal structure of the tubing hanger joint body. In some embodiments, the plurality of spacers 104 are moveable. For example, one or more spacers 104 may be removed from above the shuttle assembly 90 and placed below the shuttle assembly 90, or vice versa. Accordingly, the spacers 104 may be used to adjust a vertical positioning of the shuttle assembly 90 with respect to the BOP 26. For example, in some embodiments, the one or more spacers 104 are used to vertically adjust the shuttle assembly 90 with respect to the BOP 26 such that the brake 92 is vertically aligned with a particular portion of the BOP 26. Alternatively, or additionally, in some embodiments, the brake may be adjusted, for example, using the one or more spacers 104, to avoid a particular portion of the BOP 26, such as, a slick section of an internal diameter of the BOP 26 including a pipe ram cavity of the BOP 26. Embodiments are contemplated in which the radial pistons 94 of the brake 92 are configured to extend and interface with at least one cavity of the BOP 26. Additionally, in some embodiments, the brake 92 is operable to interface with at least a portion of the BOP 26 such as any of a pipe ram cavity, an annular preventer, or an internal bore of the BOP 26. Further still, embodiments are contemplated in which multiple braking components are used to engage multiple portions of the BOP 26.

In some embodiments, the tubing hanger orientation assembly 84 further includes a keyway 106 disposed into the longitudinal structure of the tubing hanger orientation assembly 84, as shown. The keyway 106 may be configured to receive one or more keys or pins to maintain an alignment of the exemplary tubing hanger orientation assembly 84 during vertical stroking. For example, the keyway 106 may be vertically elongated such that the keys or pins disposed therein are able to translate vertically but not tangentially to prevent further rotation of the exemplary tubing hanger orientation assembly 84 during vertical stroking.

The tubing hanger orientation assembly 84 further includes a control portion 108 operable to control one or more other devices of the tubing hanger orientation assembly 84, such as the actuator assembly 98 and the brake assembly 92. In some embodiments, a gyroscopic sensor 110 is disposed in the control portion 108. In some embodiments, the gyroscopic sensor 110 is the same device as any of gyroscope 36, linear gyroscope 66, and may perform similar functionality of said devices. For example, the gyroscopic sensor 110 may be configured to detect a rotational orientation of the tubing hanger orientation assembly 84.

In some embodiments, the control portion 108 includes any combination of a voltage converter 112, a controller board 114, a stepper pump 116, and one or more valves 118, such as solenoid operated hydraulic valves. In some embodiments, the one or more valves 118 are configured to control actuation of the brake assembly 92 and the actuator assembly 98 hydraulically. Embodiments are contemplated in which the controller board 114 is operable to control the one or more valves 118 to thereby hydraulically control the hydraulic actuators of the shuttle assembly 90. However, it should be understood that other suitable forms of actuation are also contemplated, such as, for example, electric, pneumatic, or magnetic, as well as combinations thereof, and other forms of actuation not explicitly described herein.

Figure 7:
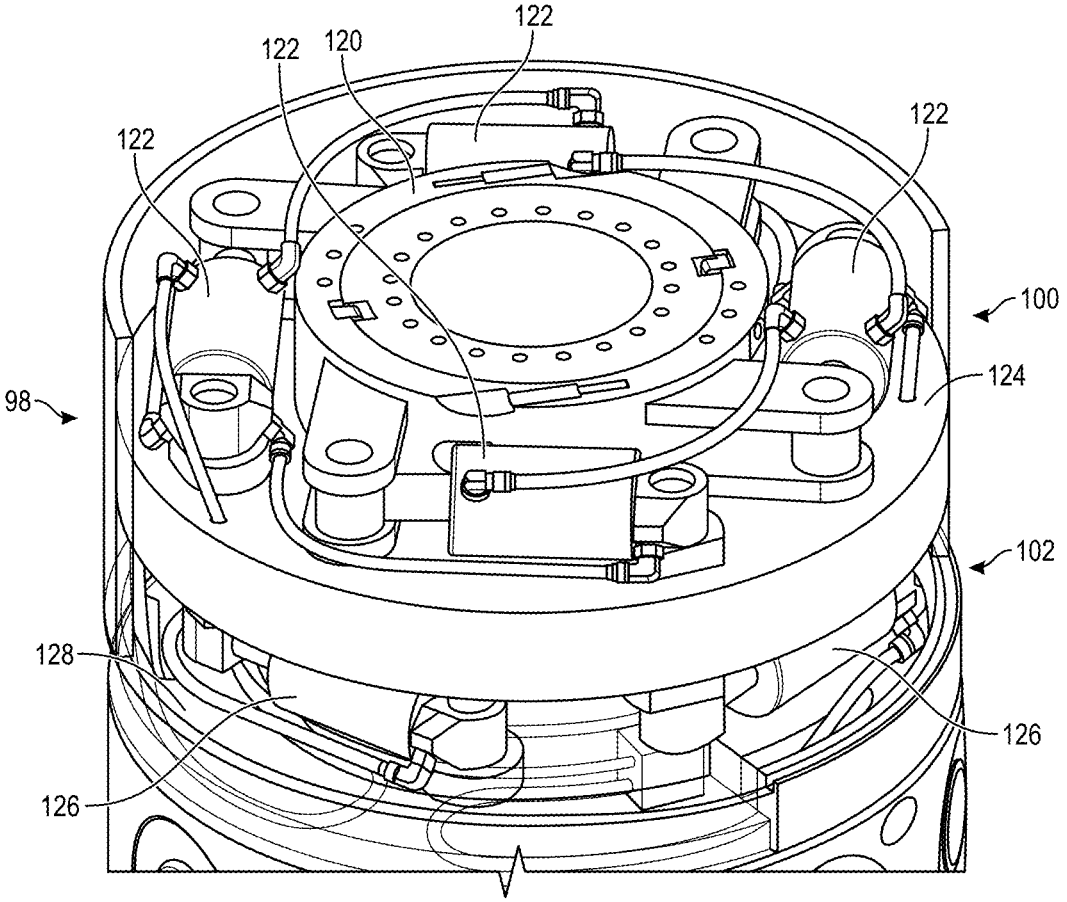
FIG. 7 illustrates the exemplary actuator assembly relating to some embodiments of the present disclosure.

FIG. 7 illustrates the exemplary actuator assembly 98 relating to some embodiments of the present disclosure. The actuator assembly 98 includes the first stage actuator array 100 and second stage actuator array 102, as described above. Additionally, the actuator assembly 98 includes a tubing hanger orientation coupling structure 120, which may be fixed to the longitudinal structure of the tubing hanger orientation joint, as shown. Further, a plurality of first stage actuators 122 are included. Each of the plurality of first stage actuators 122 is coupled at one end to the tubing hanger orientation coupling structure 120 and at another end to a first stage plate structure 124. Accordingly, when actuated, the plurality of first stage actuators 122 adjust rotation of the tubing hanger orientation coupling structure 120 with respect to the first stage plate structure 124. In some embodiments, the actuators may be hydraulically actuated; however, it should be understood that embodiments are contemplated in which other suitable forms of actuation are used.

The second stage actuator array 102 includes a plurality of second stage actuators 126. Each of the plurality of second stage actuators 126 is coupled at one end to the first stage plate structure 124 and at another end to a second stage plate structure 128. Accordingly, the plurality of second stage actuators 126, when actuated, adjust rotation of the first stage plate structure 124 with respect to the second stage plate structure 128. In some embodiments, each actuator of the plurality of first stage actuators 122 and the plurality of second stage actuators 126 includes a linear hydraulic piston operable to adjust a position between two points fixed to the ends of the respective hydraulic piston.

In some embodiments, the second stage plate structure 128 is fixed to the brake assembly 92. Accordingly, the brake assembly 92 may be used to lock rotation of the second stage plate structure 128 with respect to the BOP 26. Accordingly, during operation, the first stage plate structure 124 is rotated with respect to the BOP 26 through actuation of the plurality of second stage actuators 126. During operation, the tubing hanger orientation coupling structure 120 is further rotated with respect to the first stage plate structure 124 through actuation of the plurality of first stage actuators 122. Accordingly, in some embodiments, the actuator assembly 98 may be used to provide a rotational stroke length of approximately 50 degrees. However, it should be understood that different stroke lengths are also contemplated for some embodiments. Further, different types of rotary actuators are also contemplated. For example, in some embodiments, the rotary actuator 56 may include a vane actuator with a rotational stroke length of approximately 100 degrees.

In some embodiments, the rotary actuator 38 or the rotary actuator 56 include the two stage rotary actuator of the actuator assembly 98. Alternatively, in some embodiments, other forms of rotary actuators are contemplated such as a vane actuator or hydraulic motor.

Figure 8:
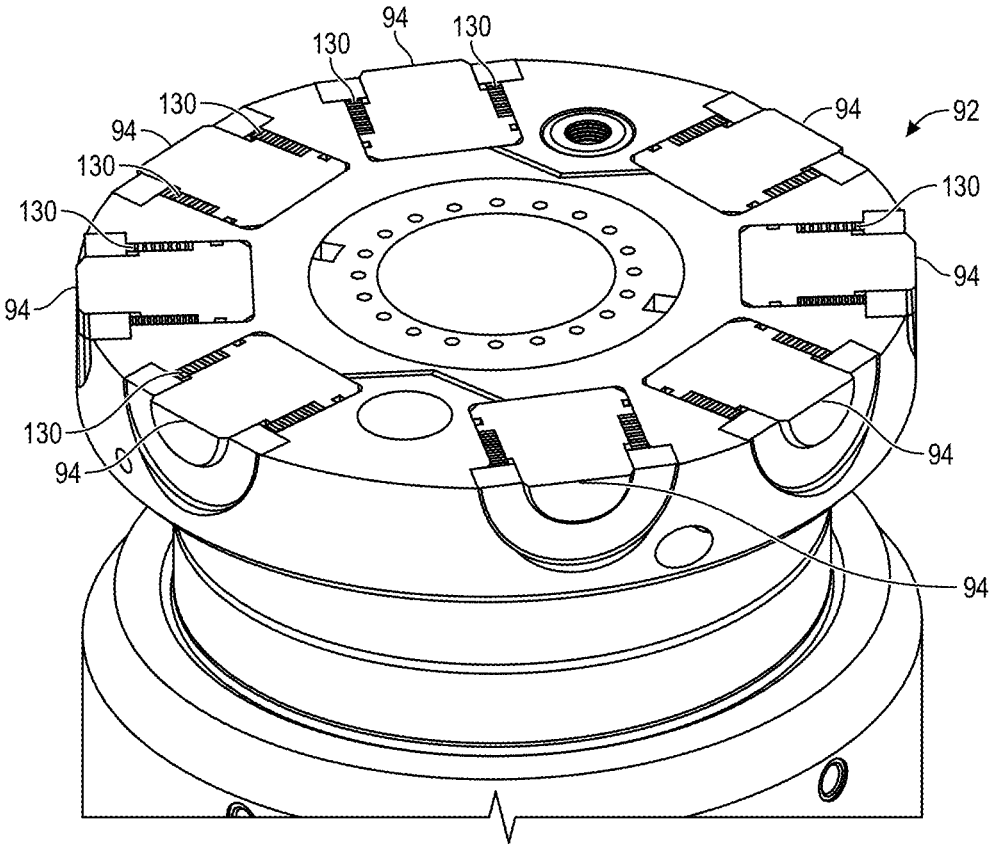
FIG. 8 illustrates a cutaway view of the exemplary brake assembly relating to some embodiments of the present disclosure.

FIG. 8 illustrates a cutaway view of the exemplary brake assembly 92 relating to some embodiments of the present disclosure. The brake assembly 92 includes a plurality of radial pistons 94, as shown. The radial pistons 94, when actuated, interface with a portion of the BOP 26, such as, for example, an internal bore surface, a pipe ram cavity, or an annular preventer of the BOP, to lock rotation of the brake assembly 92 with respect to the BOP 26. Accordingly, the brake assembly 92 provides a reaction point for rotation with the actuator assembly 98. In some embodiments, each radial piston 94 is biased into a closed position passively using corresponding springs 130. As such, when the radial pistons 94 are not actively actuated, the springs 130 push the radial pistons 94 into the retracted position to prevent interaction with the BOP 26. In some embodiments, the brake 92 is fail disengaged such that, for example, in the case of control failure, the brake 92 is passively disengaged. For example, if active actuation is lost, the radial pistons 94 may be biased into the retracted position to automatically disengage the brake 92 from the BOP 26.

Figure 9:
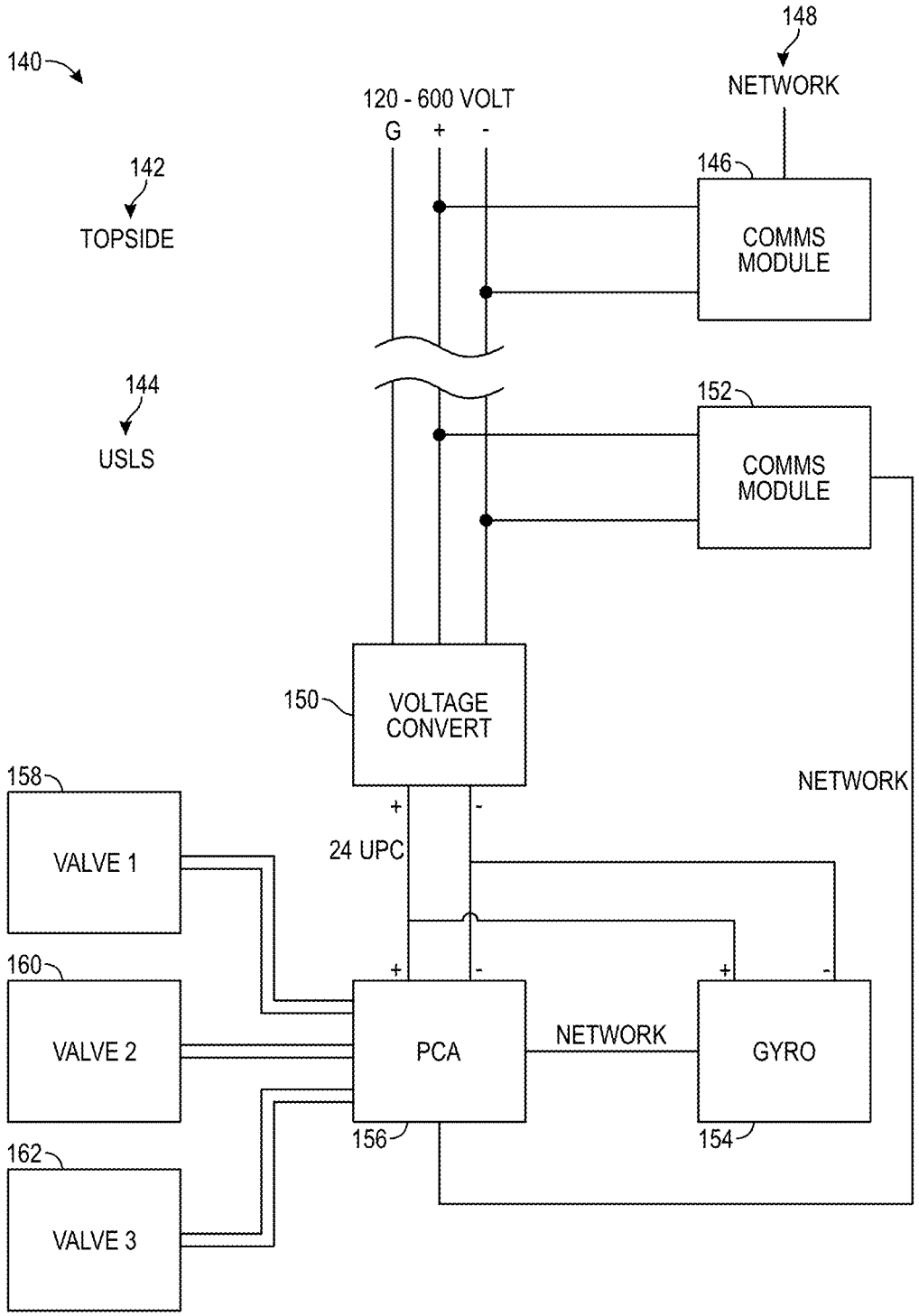
FIG. 9 illustrates an exemplary control system relating to some embodiments of the present disclosure.

FIG. 9 illustrates an exemplary control system 140 relating to some embodiments of the present disclosure. In some embodiments, the control system 140 may be used to control any of the components and devices described above. For example, the control system 140 may be used to control operation of the shuttle assembly 90 including the brake assembly 92 and the actuator assembly 98.

The control system 140 includes a topside portion 142 and a subsea portion 144. In some embodiments, a communications module 146 is included on the topside portion 142, which may be operable to communicate over a network 148, as shown. In some embodiments, the network 148 comprises any of a wired or wireless network operable to provide communication with one or more other components of the subsea well system 10.

The subsea portion 144 may include a voltage converter 150 and a communications module 152. In some embodiments, the voltage converter 150 converts an electrical voltage from the topside portion 142 to a suitable voltage level for one or more electronic devices of the subsea portion 144. For example, the voltage converter 150 may convert a 120 volt power source from the topside portion 142 to a 24 volt level for the subsea portion 144. In some embodiments, the communications module 152 provides a communication connection to the topside portion 142. For example, in some embodiments, the communications module 152 of the subsea portion 144 is operable to communicate with the communications module 146 of the topside portion 142 via network 148. In some such embodiments, the communication may be bidirectional such that the communications module 152 of the subsea portion 144 can both transmit and receive signals from the topside portion 142. For example, in some embodiments, the communications module 152 comprises a wireless transceiver portion.

The subsea portion 144 of the control system 140 further includes a gyroscope 154, which may be any of the gyroscope 36, a gyroscope of the control portion 60, or the linear gyroscope 66, as described above. In some embodiments, the gyroscope 154 interfaces with a pump controlled actuation (PCA) device 156, for example, over a network or a direct wired connection. Accordingly, in some embodiments, the PCA device 156 is operable to control one or more devices or components based at least in part on a signal from the gyroscope 154. In some embodiments, an automatic feedback loop is provided between the gyroscope 154 and a controller such that the subsea equipment may be automatically adjusted based on gyroscope orientation data without relying on topside communication.

In some embodiments, the PCA device 156 is coupled to one or more hydraulic valves, such as, a first valve 158, a second valve 160, and a third valve 162, as shown. In some embodiments, the one or more hydraulic valves are coupled to devices of the subsea system 10. For example, the one or more hydraulic valves may be hydraulically coupled to any of the rotary actuator and the brake assembly.

Figure 10:
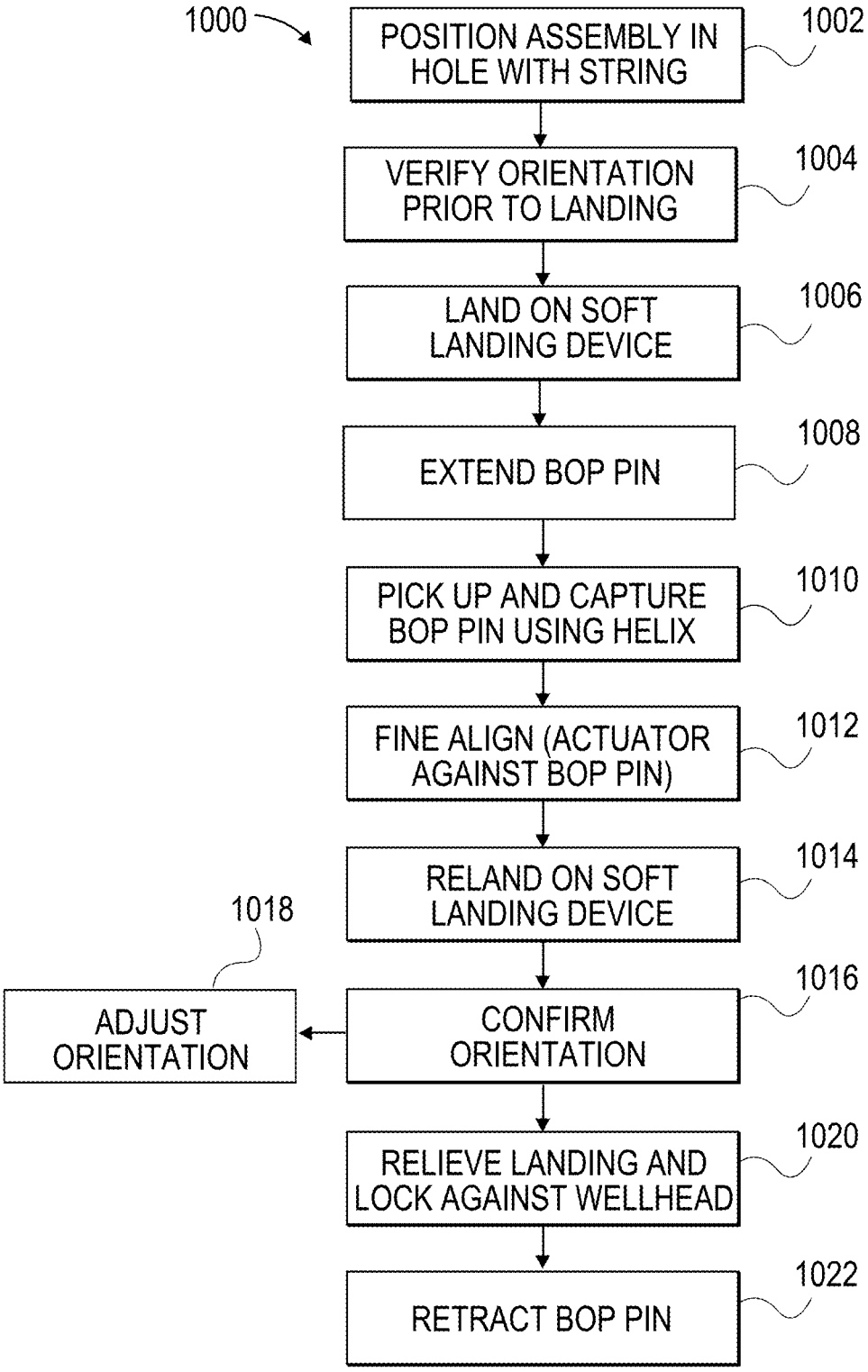
FIG. 10 illustrates an exemplary method for installing a tubing hanger assembly relating to some embodiments of the present disclosure.

FIG. 10 illustrates an exemplary method 1000 for installing a tubing hanger assembly relating to some embodiments of the present disclosure. The method 1000 may be performed using one or more components of the subsea system 10, the tubing hanger orientation system 30, the exemplary tubing hanger orientation assembly 64, or the control system 140. For example, in some embodiments, at least a portion of the steps of method 1000 are performed by executing computer-executable instructions stored on one or more non-transitory computer-readable media using at least one processor of a control component of the subsea system 10. In some embodiments, steps may be performed by executing instructions on a processor of any of the control unit 40, the control portion 60, the control unit 76, and the control portion 108.

At step 1002, the tubing hanger orientation assembly is positioned in a hole of the subsea system 10 using a string assembly, such as a landing string. For example, the tubing hanger orientation assembly may be lowered from surface level using a string assembly from the surface platform 12.

At step 1004, an orientation of the tubing hanger orientation assembly is verified prior to a landing operation. For example, a rotational orientation of the tubing hanger orientation assembly may be determined using at least one gyroscopic sensor, such as any of the gyroscopes described herein. In some embodiments, one or more external gyroscopic sensors are also used to verify the orientation. For example, a template gyroscope disposed on a template structure or a permanent guidebase may be used as a reference point.

At step 1006, the tubing hanger orientation assembly is lowered to land on a soft landing device. For example, a soft landing piston may be disposed between a lower end of the tubing hanger 22 and the wellhead 18. The soft landing piston may be configured to receive the end of the tubing hanger 22 and provide a soft landing point to couple the tubing hanger 22 and wellhead connection. The soft landing piston also prevents engagement with a gasket prior to aligning the tubing hanger in the correct position.

At step 1008, the BOP pin 42 of the BOP 26 is extended into a BOP pin receiving portion of the tubing hanger orientation assembly. As described above, the BOP pin 42 may be received into a helix structure and/or slot on a tubing hanger orientation mandrel to lock rotation with respect to the BOP 26. Accordingly, the coupling with the BOP pin 42 may be used as a reaction point to rotate the tubing hanger orientation assembly.

At step 1010, the tubing hanger orientation assembly is picked up and the BOP pin is captured using the helix structure of the tubing hanger orientation mandrel. For example, lifting of the tubing hanger orientation assembly causes the helix structure to contact and capture the BOP pin. In some embodiments, the tubing hanger orientation assembly is temporarily lifted away from the soft landing device. In some embodiments, the tubing hanger orientation assembly is oriented within 4 degrees of a desired rotational orientation responsive to interaction of the BOP pin 42 with the helix structure 70.

At step 1012, an orientation of the tubing hanger orientation assembly is aligned finely using a rotary actuator such as the high torque actuator described herein, including, for example, the rotary actuator 38, rotary actuator 56, the high torque motor 74, or the actuator assembly 98. In some embodiments, the tubing hanger orientation assembly is fine aligned using the high torque actuator reacting against the BOP pin to provide rotation. In some embodiments, the high torque rotary actuator provides fine alignment to within 1.5 degrees from a target rotational orientation. In some embodiments, the rotary actuator comprises any of a linear actuator assembly or a rotational vane actuator, as well as other suitable rotational actuators not explicitly described herein. Further, the rotary actuator may be disposed within the subsea assembly as opposed to typical tubing hanger orientation techniques, which rely on the BOP pin and typically a helix combined with vertical stroking of the string to orient the tubing hanger. Further still, in some embodiments, the rotary actuator may include a high torque actuator that provides high torque rotation of the tubing hanger orientation assembly. In some embodiments, high torque refers to a torque of above 10,000 ft-lbs. Alternatively, or in addition, embodiments are contemplated in which a high torque value is above 1,000 ft-lbs, 5,000 ft-lbs, 8,000 ft-lbs, or above 15,000 ft-lbs.

At step 1014, the tubing hanger orientation assembly is landed again onto the soft landing device. For example, an end of the tubing hanger 22 is landed back onto the soft landing piston. At step 1016, an orientation of the tubing hanger orientation assembly is confirmed, for example, using at least one gyroscopic sensor of the tubing hanger orientation assembly. In some embodiments, the gyroscopic sensor is used to verify a rotational orientation after an initial alignment with the rotary actuator. If the orientation is determined not to be within a predetermined orientation threshold by the orientation confirmation at step 1016, the orientation is further adjusted at step 1018.

At step 1018, an orientation of the tubing hanger orientation assembly is optionally adjusted. In some embodiments, the tubing hanger orientation assembly is adjusted in response to confirming that the orientation is outside of a threshold target orientation. In some embodiments, the tubing hanger orientation assembly is optionally lifted and realigned. In some embodiments, the tubing hanger orientation assembly may be lifted off of the soft landing device and realigned as needed based on a current orientation of the tubing hanger orientation assembly. Alternatively, or additionally, in some embodiments, the orientation of the tubing hanger orientation assembly is adjusted on the soft landing device without lifting off the soft landing device. In some embodiments, the adjustment is performed using the rotary actuator based at least in part on a signal from the at least one gyroscopic sensor. For example, a feedback loop may be provided between the at least one gyroscope and the control system of the rotary actuator to automatically adjust the orientation based on the gyroscope sensor until a correct installation orientation is achieved.

At step 1020, the soft landing device is relieved, and the tubing hanger is locked against the wellhead 18. In some embodiments, the soft landing device, such as a soft landing piston is relieved by bleeding off a pressure from the soft landing piston. For example, the soft landing device may be relieved until the end of the tubing hanger 22 contacts the wellhead 18 for coupling to the well head to complete installation of the tubing hanger 22.

At step 1022, the BOP pin 42 is retracted from the BOP interface point of the tubing hanger orientation assembly. The BOP pin 42 may be extended throughout the installation process until after the final alignment is confirmed. After retraction of the BOP pin 42 the landing string may be lifted and removed from the subsea system 10.

Figure 11:
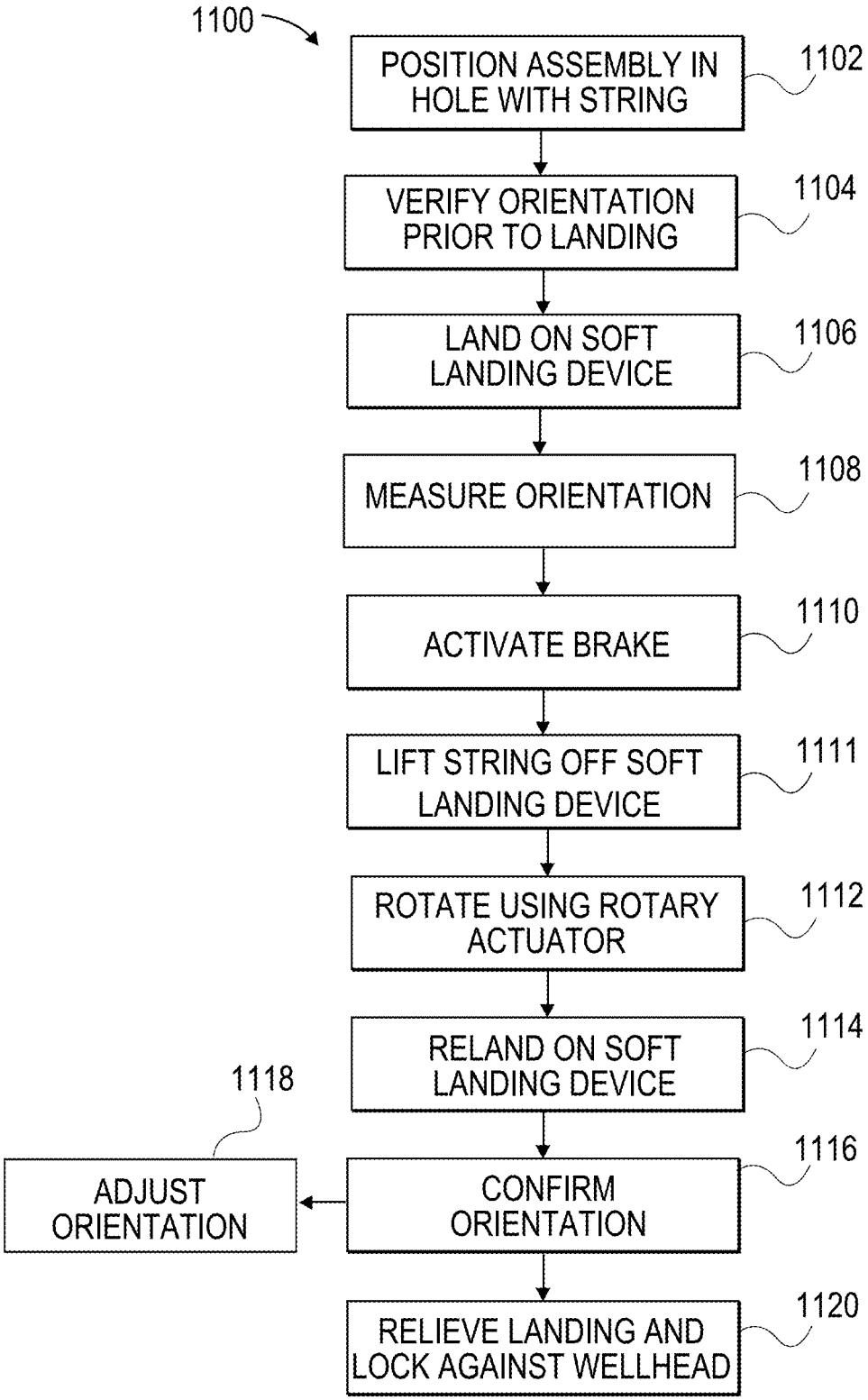
FIG. 11 illustrates an exemplary method for installing a tubing hanger assembly relating to some embodiments of the present disclosure.

FIG. 11 illustrates an exemplary method 1100 for installing a tubing hanger assembly relating to some embodiments of the present disclosure. Similar to the method 1000, the method 1100 may be performed using one or more components of the subsea system 10, the tubing hanger orientation system 30, the exemplary tubing hanger orientation assembly 64, or the control system 140. For example, in some embodiments, at least a portion of the steps of method 1100 are performed by executing computer-executable instructions stored on one or more non-transitory computer-readable media using at least one processor of a control component of the subsea system 10. In some embodiments, steps may be performed by executing instructions on a processor of any of the control unit 40, the control portion 60, the control unit 76, and the control portion 108.

At step 1102, the tubing hanger orientation assembly is positioned in a hole of the subsea system 10 using a string assembly, such as a landing string. For example, the tubing hanger orientation assembly may be lowered from surface level using a string assembly from the surface platform 12.

At step 1104, an orientation of the tubing hanger orientation assembly is verified prior to a landing operation. For example, a rotational orientation of the tubing hanger orientation assembly may be determined using at least one gyroscopic sensor, such as any of the gyroscopes described herein. In some embodiments, one or more external gyroscopic sensors are also used to verify the orientation. For example, a template gyroscope disposed on a template structure may be used as a reference point.

At step 1106, the tubing hanger orientation assembly is lowered to land on a soft landing device. For example, a soft landing piston may be disposed between a lower end of the tubing hanger 22 and the wellhead 18. The soft landing piston may be configured to receive the end of the tubing hanger 22 and provide a soft landing point to couple the tubing hanger 22 and wellhead connection.

At step 1108, an orientation of the tubing hanger orientation assembly is measured, for example, using at least one of the gyroscopic sensors described herein, such as, gyroscope 36 or linear gyroscope 66. In some embodiments, an initial rotational orientation is measured to determine a rotational adjustment value for subsequent rotational adjustment of the tubing hanger orientation assembly.

At step 1110, a brake of the tubing hanger orientation assembly is activated. For example, in some embodiments, brake assembly 92 may be activated to interface with an internal bore of the BOP 26 to lock rotation of the brake assembly 92 with the BOP 26. In some such embodiments, the BOP pin 42 is not used as a reaction point and instead, the brake assembly 92 is used to lock rotation with the BOP 26.

At step 1111, the string assembly is lifted off of the soft landing device. In some embodiments, the string assembly is lifted, including the tubing hanger orientation assembly and tubing hanger, prior to rotating the string assembly such that the string assembly freely rotates without contacting the soft landing device.

At step 1112, the tubing hanger orientation assembly is rotated using the rotary actuator such as the rotary actuator 56, which may include the actuator assembly 98. For example, the tubing hanger orientation assembly may be rotated using the two stage actuator assembly described above with respect to FIG. 7. In some embodiments, the rotary actuator provides a fine adjustment or fine alignment to the rotational orientation of the tubing hanger orientation assembly, for example, within a rotational orientation range of 2 degrees, 1.95 degrees, 1.5 degrees, 1 degree, 0.8 degrees, 0.5 degrees, 0.2 degrees, 0.1 degrees, 0.05 degrees, 0.02 degrees, and 0.01 degrees in either direction from a final desired rotation. In some embodiments, the accuracy of the fine alignment is up to less than 1 degree from a desired heading for the tubing hanger.

At step 1114, the tubing hanger orientation assembly is landed again onto the soft landing device. For example, an end of the tubing hanger 22 is landed back onto the soft landing piston. At step 1116, a rotational orientation of the tubing hanger orientation assembly is confirmed, after the initial alignment adjustment, using at least one gyroscopic sensor.

If the rotational orientation confirmation of the tubing hanger orientation assembly at step 1116 is determined not to be within a predetermined orientation threshold, the orientation is further adjusted at step 1118. For example, the orientation may be adjusted by rotating the tubing hanger orientation assembly using the rotary actuator responsive to a signal from the at least one gyroscopic sensor. In some embodiments, the predetermined orientation threshold may be determined based on an intended orientation range of the tubing hanger 22 to ensure that the tubing hanger 22 properly aligns with other components of the subsea system 10, such as, for example, a subsea tree assembly. In some embodiments, the tubing hanger orientation assembly is lifted away from the soft landing device prior to adjusting orientation. Alternatively, or additionally, embodiments are contemplated in which the tubing hanger orientation assembly is adjusted on the soft landing device without lifting off of the soft landing device.

At step 1120, the soft landing device is relieved, and the tubing hanger is locked against the wellhead 18. In some embodiments, the soft landing device, such as a soft landing piston is relieved by bleeding off a pressure from the soft landing piston. For example, the soft landing device may be relieved until the end of the tubing hanger 22 contacts the wellhead 18 for coupling to the well head to complete installation of the tubing hanger 22.

The following embodiments represent exemplary embodiments of concepts contemplated herein. Any one of the following embodiments may be combined in a multiple dependent manner to depend from one or more other clauses. Further, any combination of dependent embodiments (e.g., clauses that explicitly depend from a previous clause) may be combined while staying within the scope of aspects contemplated herein. The following clauses are exemplary in nature and are not limiting.

Clause 1. A tubing hanger orientation assembly for coupling a tubing hanger assembly to a wellhead, the tubing hanger orientation assembly comprising: a tubing hanger orientation mandrel operable to be placed within an internal bore of a blowout preventer (BOP) associated with the wellhead; a rotary actuator operable to drive rotation of the tubing hanger orientation mandrel with respect to the BOP; a reaction point for rotation of the tubing hanger orientation mandrel with respect to the BOP; and at least one gyroscopic sensor operable to measure an orientation of the tubing hanger assembly.

Clause 2. The tubing hanger orientation assembly of clause 1, wherein the reaction point comprises a BOP pin receiving structure operable to interface with a BOP pin of the BOP.

Clause 3. The tubing hanger orientation assembly of any of clauses 1 or 2, wherein the reaction point comprises a brake operable to interface with a portion of the BOP.

Clause 4. The tubing hanger orientation assembly of any of clauses 1-3, wherein the brake includes a plurality of radial pistons that, when actuated, interface with the portion of the BOP.

Clause 5. The tubing hanger orientation assembly of any of clauses 1-4, wherein the brake further includes a standoff piston operable to maintain a clearance that permits upward stroking of the tubing hanger orientation assembly.

Clause 6. The tubing hanger orientation assembly of any of clauses 1-5, wherein the rotary actuator comprises an array of linear actuators operable to drive rotation of the tubing hanger assembly with respect to the BOP.

Clause 7. The tubing hanger orientation assembly of any of clauses 1-6, wherein the rotary actuator is automatically driven based on a signal from the at least one gyroscopic sensor.

Clause 8. A tubing hanger orientation assembly for coupling a tubing hanger assembly to a wellhead, the tubing hanger orientation assembly comprising: a tubing hanger orientation mandrel operable to be placed within an internal bore of a blowout preventer (BOP) associated with the wellhead; a rotary actuator operable to drive rotation of the tubing hanger orientation mandrel with respect to the BOP; a brake operable to interface with a portion of the BOP such that a reaction point is provided for rotation of the tubing hanger orientation mandrel with respect to the BOP; and at least one gyroscopic sensor operable to measure an orientation of the tubing hanger assembly.

Clause 9. The tubing hanger orientation assembly of clause 8, wherein the rotary actuator comprises a two stage piston assembly comprising: a plurality of first stage pistons; a first stage plate structure coupled to the plurality of first stage pistons; a plurality of second stage pistons; and a second stage plate structure coupled to the plurality of second stage pistons.

Clause 10. The tubing hanger orientation assembly of any of clauses 8-9, wherein a rotational stroke length of the two stage piston assembly is approximately 50 degrees.

Clause 11. The tubing hanger orientation assembly of any of clauses 8-10, wherein the rotary actuator comprises a hydraulic vane actuator with a rotational stroke length of approximately 100 degrees.

Clause 12. The tubing hanger orientation assembly of any of clauses 8-11, wherein the brake comprises a plurality of radial pistons, and wherein each radial piston of the plurality of radial pistons is coupled to a spring operable to bias the plurality of radial pistons into a deactivated position.

Clause 13. The tubing hanger orientation assembly of any of clauses 8-12, wherein each of the rotary actuator and the brake comprise a clam-shell layout such that the rotary actuator and the brake each comprise two or more distinct sections operable to be disposed on opposing sides of the tubing hanger orientation mandrel.

Clause 14. The tubing hanger orientation assembly of any of clauses 8-13, further comprising: a plurality of removable spacers disposed around the tubing hanger orientation mandrel to vertically align the brake within the BOP.

Clause 15. The tubing hanger orientation assembly of any of clauses 8-14, wherein the brake includes a plurality of radial pistons that, when actuated, interface with the portion of the BOP.

Clause 16. A tubing hanger orientation assembly for coupling a tubing hanger assembly to a wellhead, the tubing hanger orientation assembly comprising: a tubing hanger orientation mandrel operable to be placed within an internal bore of a blowout preventer (BOP) associated with the wellhead; a rotary actuator operable to drive rotation of the tubing hanger orientation mandrel with respect to the BOP; a BOP pin receiving structure that interfaces with a BOP pin of the BOP, thereby providing a reaction point for rotation of the tubing hanger orientation mandrel with respect to the BOP; and at least one gyroscopic sensor operable to measure an orientation of the tubing hanger assembly.

Clause 17. The tubing hanger orientation assembly of clause 16, wherein the at least one gyroscopic sensor comprises a linear gyroscope disposed along a longitudinal portion of the tubing hanger orientation mandrel.

Clause 18. The tubing hanger orientation assembly of any of clauses 16-17, further comprising: a control unit operable to control the rotary actuator based at least in part on a signal from the at least one gyroscopic sensor.

Clause 19. The tubing hanger orientation assembly of any of clauses 16-18, wherein the BOP pin receiving structure comprises a helix structure and a slot for receiving the BOP pin therein.

Clause 20. The tubing hanger orientation assembly of any of clauses 16-19, wherein the rotary actuator comprises an array of linear hydraulic actuators operable to adjust rotation between two or more fixed points.

Low torque tubing hanger orientation techniques are described in U.S. patent application Ser. No. 18/906,791, titled "LOW TORQUE ACTUATED TUBING HANGER ORIENTATION", filed Oct. 4, 2024, which is hereby incorporated by reference in its entirety into the present disclosure. The subject matter of which may be combined with the subject matter of the present disclosure. For example, one or embodiments, features, structures, acts, etc. described in the foregoing U.S. patent application may be combined with one or more embodiments, features, structures, acts, etc. described in the present disclosure.

Although the present disclosure has been described with reference to the embodiments illustrated in the attached drawing figures, it is noted that equivalents may be employed and substitutions made herein without departing from the scope of the present disclosure as recited in the claims.

Having thus described various embodiments of the present disclosure, what is claimed as new and desired to be protected by Letters Patent includes the following:

What is claimed is:

1. A tubing hanger orientation assembly for coupling a tubing hanger assembly to a wellhead, the tubing hanger orientation assembly comprising:

a tubing hanger orientation mandrel operable to be placed within an internal bore of a blowout preventer (BOP) associated with the wellhead;

a rotary actuator operable to drive rotation of the tubing hanger orientation mandrel with respect to the BOP, the rotary actuator comprising a two stage piston assembly, wherein the two stage piston assembly comprises:

a plurality of first stage pistons;

a first stage plate structure coupled to the plurality of first stage pistons;

a plurality of second stage pistons; and a second stage plate structure coupled to the plurality of second stage pistons;

a reaction point for rotation of the tubing hanger orientation mandrel with respect to the BOP; and at least one sensor operable to measure an orientation of the tubing hanger assembly.

2. The tubing hanger orientation assembly of claim 1, wherein the reaction point comprises a BOP pin receiving structure operable to interface with a BOP pin of the BOP.

3. The tubing hanger orientation assembly of claim 1, wherein the reaction point comprises a brake operable to interface with a portion of the BOP.

4. The tubing hanger orientation assembly of claim 3, wherein the brake includes a plurality of radial pistons that, when actuated, interface with the portion of the BOP.

5. The tubing hanger orientation assembly of claim 4, wherein the brake further includes a standoff piston operable to maintain a clearance that permits upward stroking of the tubing hanger orientation assembly.

6. The tubing hanger orientation assembly of claim 1, wherein the rotary actuator comprises an array of linear actuators operable to drive rotation of the tubing hanger assembly with respect to the BOP.

7. The tubing hanger orientation assembly of claim 6, wherein the rotary actuator is automatically driven based on a signal from the at least one sensor.

8. The tubing hanger orientation assembly of claim 1, further comprising:

a linear gyroscope disposed along a longitudinal portion of the tubing hanger orientation mandrel.

9. A tubing hanger orientation assembly for coupling a tubing hanger assembly to a wellhead, the tubing hanger orientation assembly comprising:

a tubing hanger orientation mandrel operable to be placed within an internal bore of a blowout preventer (BOP) associated with the wellhead;

a rotary actuator operable to drive rotation of the tubing hanger orientation mandrel with respect to the BOP, the rotary actuator comprising a two stage piston assembly comprising:

a plurality of first stage pistons;

a first stage plate structure coupled to the plurality of first stage pistons;

a plurality of second stage pistons; and a second stage plate structure coupled to the plurality of second stage pistons;

a brake operable to interface with a portion of the BOP such that a reaction point is provided for rotation of the tubing hanger orientation mandrel with respect to the BOP; and at least one gyroscopic sensor operable to measure an orientation of the tubing hanger assembly.

10. The tubing hanger orientation assembly of claim 9, wherein a rotational stroke length of the two stage piston assembly is approximately 50 degrees.

11. The tubing hanger orientation assembly of claim 9, further comprising:

a vertically elongated keyway disposed on the tubing hanger orientation mandrel operable to maintain a heading of the tubing hanger assembly during vertical stroking of the tubing hanger orientation assembly.

12. The tubing hanger orientation assembly of claim 9, wherein the brake comprises a plurality of radial pistons, and wherein each radial piston of the plurality of radial pistons is coupled to a spring operable to bias the plurality of radial pistons into a deactivated position.

13. The tubing hanger orientation assembly of claim 9, wherein each of the rotary actuator and the brake comprise a clam-shell layout such that the rotary actuator and the brake each comprise two or more distinct sections operable to be disposed on opposing sides of the tubing hanger orientation mandrel.

14. The tubing hanger orientation assembly of claim 9, further comprising:

a plurality of removable spacers disposed around the tubing hanger orientation mandrel to vertically align the brake within the BOP.

15. The tubing hanger orientation assembly of claim 14, wherein the brake includes a plurality of radial pistons that, when actuated, interface with the portion of the BOP.

16. A tubing hanger orientation assembly for coupling a tubing hanger assembly to a wellhead, the tubing hanger orientation assembly comprising:

a tubing hanger orientation mandrel operable to be placed within an internal bore of a blowout preventer (BOP) associated with the wellhead;

a rotary actuator operable to drive rotation of the tubing hanger orientation mandrel with respect to the BOP, the rotary actuator comprising a two stage piston assembly, wherein the two stage piston assembly comprises:

a plurality of first stage pistons;

a first stage plate structure coupled to the plurality of first stage pistons;

a plurality of second stage pistons; and a second stage plate structure coupled to the plurality of second stage pistons;

a BOP pin receiving structure that interfaces with a BOP pin of the BOP, thereby providing a reaction point for rotation of the tubing hanger orientation mandrel with respect to the BOP; and at least one gyroscopic sensor operable to measure an orientation of the tubing hanger assembly.

17. The tubing hanger orientation assembly of claim 16, wherein the at least one gyroscopic sensor comprises a linear gyroscope disposed along a longitudinal portion of the tubing hanger orientation mandrel.

18. The tubing hanger orientation assembly of claim 16, further comprising:

a control unit operable to control the rotary actuator based at least in part on a signal from the at least one gyroscopic sensor.

19. The tubing hanger orientation assembly of claim 16, wherein the BOP pin receiving structure comprises a helix structure and a slot for receiving the BOP pin therein.

20. The tubing hanger orientation assembly of claim 16, wherein the rotary actuator comprises an array of linear hydraulic actuators operable to adjust rotation between two or more fixed points.

* * * * *